US010781412B2

(12) United States Patent
Shin

(10) Patent No.: US 10,781,412 B2
(45) Date of Patent: Sep. 22, 2020

(54) DETERGENT IN THE FORM OF A LAUNDRY STORAGE ENVELOPE HAVING ENHANCED RESISTANCE TO WATER

(71) Applicant: LG Household & Health Care Ltd., Seoul (KR)

(72) Inventor: Man Sup Shin, Seoul (KR)

(73) Assignee: LG Household & Health Care Ltd. (KR)

( * ) Notice: Subject to any disclaimer, the term of this patent is extended or adjusted under 35 U.S.C. 154(b) by 0 days.

(21) Appl. No.: 16/333,015

(22) PCT Filed: Sep. 20, 2017

(86) PCT No.: PCT/KR2017/010357
§ 371 (c)(1),
(2) Date: Mar. 13, 2019

(87) PCT Pub. No.: WO2018/056705
PCT Pub. Date: Mar. 29, 2018

(65) Prior Publication Data

US 2019/0276781 A1 Sep. 12, 2019

(30) Foreign Application Priority Data

Sep. 20, 2016 (KR) ..... 10-2016-0119846

(51) Int. Cl.

| | |
|---|---|
| ***C11D 1/83*** | (2006.01) |
| ***C11D 17/04*** | (2006.01) |
| ***C11D 3/10*** | (2006.01) |
| ***C11D 3/20*** | (2006.01) |
| ***C11D 3/37*** | (2006.01) |
| ***C11D 11/00*** | (2006.01) |
| ***C11D 17/06*** | (2006.01) |
| ***C11D 3/24*** | (2006.01) |
| ***C11D 3/40*** | (2006.01) |
| ***C11D 3/386*** | (2006.01) |
| ***C11D 3/395*** | (2006.01) |
| ***C11D 1/12*** | (2006.01) |
| ***C11D 3/16*** | (2006.01) |
| ***C11D 17/00*** | (2006.01) |
| ***C11D 3/50*** | (2006.01) |
| ***C11D 1/72*** | (2006.01) |
| *C11D 1/14* | (2006.01) |
| *C11D 1/722* | (2006.01) |

(52) U.S. Cl.

CPC ..... *C11D 17/042* (2013.01); *C11D 1/12* (2013.01); *C11D 1/72* (2013.01); *C11D 1/8305* (2013.01); *C11D 3/10* (2013.01); *C11D 3/162* (2013.01); *C11D 3/2065* (2013.01); *C11D 3/24* (2013.01); *C11D 3/245* (2013.01); *C11D 3/37* (2013.01); *C11D 3/373* (2013.01); *C11D 3/3749* (2013.01); *C11D 3/3753* (2013.01); *C11D 3/386* (2013.01); *C11D 3/395* (2013.01); *C11D 3/40* (2013.01); *C11D 3/50* (2013.01); *C11D 11/0017* (2013.01); *C11D 17/00* (2013.01); *C11D 17/06* (2013.01); *C11D 1/143* (2013.01); *C11D 1/722* (2013.01)

(58) Field of Classification Search
None
See application file for complete search history.

(56) References Cited

U.S. PATENT DOCUMENTS

| | | | | |
|---|---|---|---|---|
| 3,279,511 | A * | 10/1966 | Griffin, Jr. | D06F 95/004 383/1 |
| 5,300,358 | A * | 4/1994 | Evers | A61F 13/15 428/422 |
| 5,599,893 | A | 2/1997 | Asai et al. | |
| 2008/0008859 | A1* | 1/2008 | Catalfamo | C11D 17/042 428/143 |
| 2008/0242572 | A1* | 10/2008 | Icht | C11D 17/06 510/120 |
| 2016/0279075 | A1* | 9/2016 | Redmond | A01N 25/04 |
| 2017/0313962 | A1* | 11/2017 | Shin | C11D 3/2093 |

FOREIGN PATENT DOCUMENTS

| | | | |
|---|---|---|---|
| CN | 105500854 | A | 4/2016 |
| JP | 2009541102 | A | 11/2009 |
| KR | 100370899 | B1 | 3/2003 |
| KR | 100814285 | B1 | 3/2008 |
| KR | 101443497 | B1 | 9/2014 |
| KR | 20160044917 | A | 4/2016 |
| KR | 20180031617 | A | 3/2018 |
| TW | 200808542 | A | 2/2008 |
| WO | 0046342 | A1 | 8/2000 |
| WO | 2007034471 | A2 | 3/2007 |
| WO | 2016060378 | A1 | 4/2016 |

OTHER PUBLICATIONS

International Search Report From PCT/KR2017/010357 dated Jan. 15, 2018.
Chinese Search Report for Application No. 201780051048.7 dated Jun. 15, 2020, 2 pages.

* cited by examiner

*Primary Examiner* — Charles I Boyer
(74) *Attorney, Agent, or Firm* — Lerner, David, Littenberg, Krumholz & Mentlik, LLP

(57) ABSTRACT

A detergent in the form of an envelope including a water-repellent component such that, even when wet laundry is stored, the shape stability of the detergent in the form of the envelope can be maintained.

10 Claims, 2 Drawing Sheets

[water contact]

[After 5 mins]

[Water permeability (not permeable when coating)]

[Storing wet tissue (Confirmation of improvement of wetness compared to conventional manner)]

DETERGENT IN THE FORM OF A LAUNDRY STORAGE ENVELOPE HAVING ENHANCED RESISTANCE TO WATER

CROSS-REFERENCE TO RELATED APPLICATIONS

This application is a national phase entry under 35 U.S.C. § 371 of International Patent Application No. PCT/KR2017/010357, filed Sep. 20, 2017, which claims priority to Korean Patent Application No. 10-2016-0119846, filed Sep. 20, 2016, the disclosures of which are incorporated herein by reference.

TECHNICAL FIELD

The present invention relates to a laundry detergent, and more particularly, to a detergent in the form of an envelope (Hereinafter referred to as an "envelope-type detergent" in some cases.) capable of containing the laundry.

BACKGROUND ART

In general, the laundry is washed by introducing a detergent into a washing machine. However, it is practically difficult to accurately determine the amount of laundry and the standard amount of the detergent to be used, and thus the user can arbitrarily measure the amount of detergent for use. Therefore, there is a problem that the detergent is excessively used or underused so that the desired washing effect cannot be obtained. Further, due to the problems associated with a space and costs, the laundry is usually gathered and stored until a pile of the laundry reaches a predetermined level, and then the laundry is classified and introduced into a washing machine to wash the laundry, and the odor and touch from the laundry stored during the classifying process cause discomfort and cumbersomeness.

In order to solve the above problems, the present inventors have researched and developed an envelope-type detergent which can contain laundry and a detergent composition for preparing an envelope-type detergent which can contain laundry, as disclosed in Korean Patent Laid-open No. 10-2016-0044917.

However, the envelope-type detergent employs a water-soluble polymer film structure for manufacturing the form of an envelope and washing property. In some cases, the detergent bag is wetted by water contained in the laundry while the laundry is stored. Thus, it was necessary to improve the shape stability of the detergent bag while the laundry is stored.

DISCLOSURE

Technical Problem

In order to solve the problems, the present invention provides an envelope-type detergent composition containing a water-repellent component, thereby providing an envelope detergent with improved water resistance.

Technical Solution

In order to address the issues, the envelope-type detergent according to the present invention includes a fluorine-based compound and/or a silicon-based compound for the water resistance enhancement. The fluorine-based compound and the silicone-based compound are mainly used as a cleansing agent for outdoor and functional fiber materials. However, in the present invention, the fluorine-based compound and/or the silicon-based compound is applied alone or as a mixture of two or more thereof in the water-soluble film constituting the envelope-type detergent, or a method of adding them during mixing raw materials of detergent compositions is applied so as to exhibit a water-repellent effect upon forming a polymer film.

Therefore, the present invention provides an envelope-type detergent including an envelope-type detergent composition and at least one water-repellent compound selected from the group consisting of a fluorine-based compound and a silicone-based compound.

According to a preferred embodiment of the present invention, the water-repellent compound is preferably included in 1 part by weight to 20 parts by weight with respect to the total weight of the envelope-type detergent composition.

According to another preferred embodiment of the present invention, the fluorine-based water-repellent compound is preferably at least one selected from the group consisting of a fluorine-based perfluoroalkyl compound, a perfluorosilane compound, a mixture thereof and a polymer thereof.

According to yet another preferred embodiment of the present invention, the silicone-based water-repellent compound is preferably at least one selected from the group consisting of an alkylalkoxysilane compound, an organoalkoxysiloxane compound, a mixture thereof and a polymer thereof.

According to yet another preferred embodiment of the present invention, the envelope-type detergent composition preferably includes: a) 3 parts by weight to 40 parts by weight of a nonionic surfactant; b) 5 parts by weight to 40 parts by weight of an anionic surfactant; c) 5 parts by weight to 90 parts by weight of the film-forming water-soluble polymer as the total weight thereof after drying; d) 1 part by weight to 30 parts by weight of an alkali builder; and e) 1 part by weight to 20 parts by weight of a plasticizer.

According to yet another preferred embodiment of the present invention, a) the nonionic surfactant preferably includes at least one selected from the group consisting of polyoxyethylene alkyl ether, coconut diethanolamide, fatty acid alkanolamine, amine oxide, alkyl polyglucoside, methyl polyethylene alkyl ether, and sugar ether.

According to yet another preferred embodiment of the present invention, b) the anionic surfactant preferably includes at least one selected from the group consisting of alpha-sulfo fatty acid methyl ester salt, alpha-olefin sulfonate and sodium lauryl sulfate.

According to yet another preferred embodiment of the present invention, c) the film-forming water-soluble polymer preferably is polyvinyl alcohol having a degree of saponification of 75% to 95% and an average degree of polymerization of 100 to 3,000.

According to yet another preferred embodiment of the present invention, d) the alkali builder preferably includes at least one selected from the group consisting of potassium carbonate, sodium carbonate, sodium bicarbonate and sodium sulfate.

According to yet another preferred embodiment of the present invention, e) the plasticizer preferably includes at least one selected from the group consisting of trimethylol propane, ethylene glycol, dibutyl phthalate and citric acid.

According to a preferred embodiment of the present invention, the envelope-type detergent composition may preferably further include at least one additive selected from the group consisting of a flavor, a protease, a lipase, a carbohydrase, a cellulolytic enzyme, a bleach, a fluorescent dye, a dye migration inhibitor in an amount of 0.3 parts by weight to 10 parts by weight with respect to 100 parts by weight of the envelope-type detergent composition.

Advantageous Effects

According to the present invention, it is possible to solve the problem that the envelope-type detergent is soluble due to the polymer dissolved even at a low temperature when the wet laundry is stored, which is caused in the case of the envelope-type detergent not containing the conventional water-repellent component. In other words, since the envelope-type detergent according to the present invention has a water-repellent component, even when a polymer dissolved at a low temperature is used, the water resistance is enhanced. Thus, even when the wet laundry is stored, the detergent envelope has excellent shape stability and is also convenient to store.

Further, the envelope-type detergent according to the present invention may be used while the laundry is introduced into a detergent envelope formulated into a disposable preparation, and it is possible to provide an envelope-type detergent having various sizes so that it is easy to quantify the amount of the detergent to be used.

BEST MODE

Figure 1:
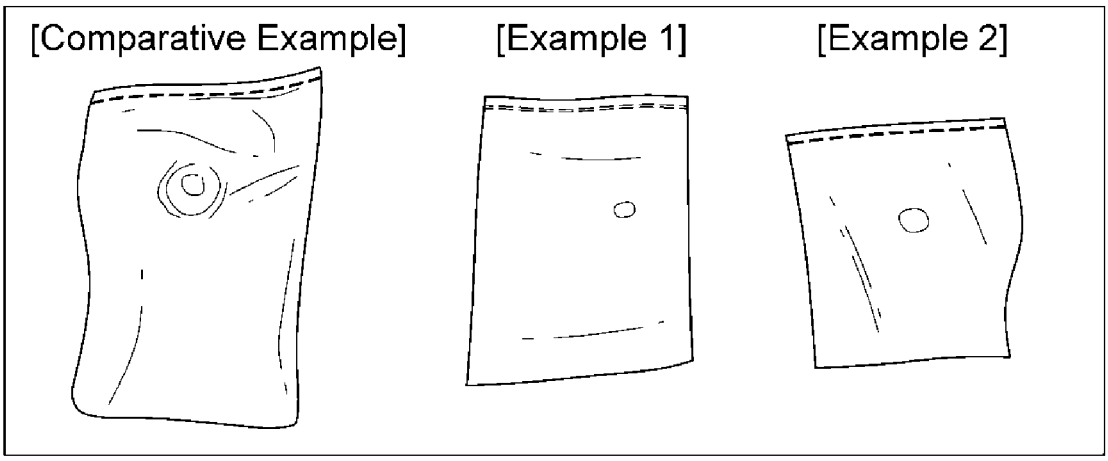
FIG. 1 is a view illustrating the results of observing changes over time when water droplets were brought into contact with the envelope-type detergent films of Examples 1 and 2 and Comparative Example.
Figure 1:
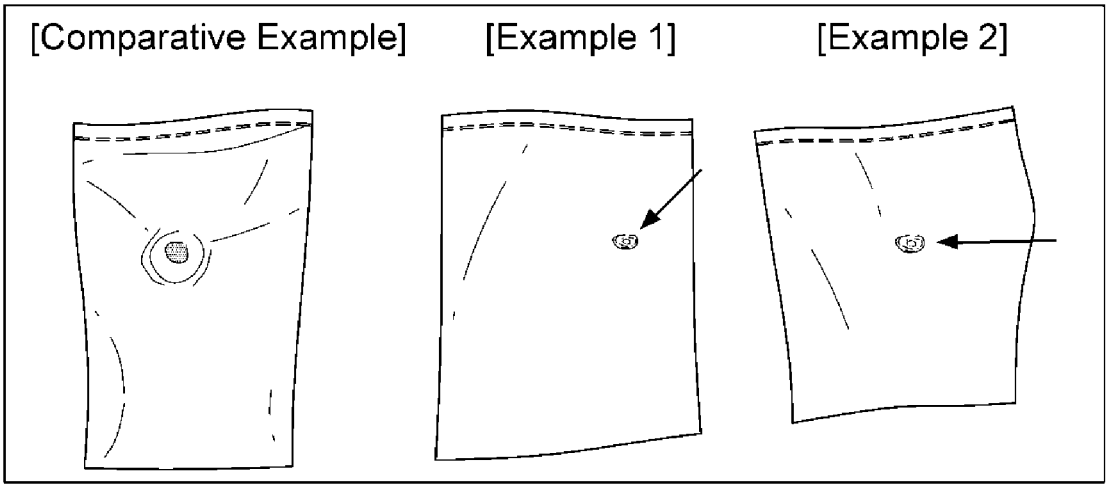

Hereinafter, the present invention is described in more detail.

The present inventors have studied on a method capable of solving the problem in that a washing effect cannot be completely obtained by excessively or sparingly using the detergent when the laundry is laundered and capable of eliminating the chore in that the laundry is stored in the same container until a pile of the laundry reaches a predetermined level, and then the laundry needs to be classified according to various classification criteria and the discomfort caused by storing the laundry, thereby completing the development of the envelope-type detergent. However, such an envelope-type detergent is based on a water-soluble polymer which is dissolved even at a low temperature in order to provide a detergent composition having excellent detergency against cold water, and if the wet laundry is placed and stored, the envelope-type detergent is dissolved. Accordingly, the present inventors have repeatedly studied to develop an envelope-type detergent having excellent shape stability even when storing wet laundry.

The envelope-type detergent according to the present invention includes an envelope-type detergent composition and at least one water-repellent compound selected from the group consisting of a fluorine-based compound and a silicone-based compound.

The water-repellent compound is a component capable of imparting water resistance to the envelope-type detergent and is preferably contained in an amount of 1 part by weight to 20 parts by weight, more preferably 1 part by weight to 10 parts by weight, even more preferably 1 part by weight to 5 parts by weight. When the water-repellent compound is contained in an amount of less than 1 part by weight, the water repellency cannot be obtained. When the water-repellent compound is more than 20 parts by weight, it is not preferable that the water-soluble film is not formed, and the formulation is solidified so as to show the low solubility. The water-repellent component may be provided as a manner of coating the envelope-type detergent with a water-repellent compound during the post-processing of the detergent film after preparing the envelope-type detergent, or a manner of preparing as an envelope-type detergent after adding and mixing the water-repellent compound together with the raw material of the envelope-type detergent composition.

A fluorine-based water-repellent agent or a silicone-based water-repellent agent can be used as the water-repellent compound.

As the fluorine-based water-repellent agent, a commonly used fluorine-based water-repellent agent that does not impair the effect of the present invention may be used, but the fluorine-based water-repellent agent preferably includes one or more selected from the group consisting of a fluorine-based perfluoroalkyl compound, a perfluorosilane compound and a polymer thereof. For example, a C6-alkyl fluororesin or a C4-alkyl fluororesin may be preferably used so that PFOA (perfluorooctanoic acid) does not occur. In a preferred embodiment, a commercially available product such as Nuva® N1811 Archroma may be used.

Further, as the silicone-based water-repellent agent, a commonly used silicone-based water-repellent agent that does not impair the effect of the present invention may be used, but the silicone-based water-repellent agent may include one or more selected from the group consisting of an alkylalkoxysilane compound and an organoalkoxysiloxane compound.

The alkylalkoxysilane may preferably include, for example, hexyltrimethoxysilane, hexyltriethoxysilane, heptyltrimethoxysilane, heptyltriethoxysilane, octyltrimethoxysilane, octyltriethoxysilane, nonyltrimethoxysilane, nonyltriethoxysilane, decyltriethoxysilane, undecyltriethoxysilane, dodecyltriethoxysilane, alkylalkoxysilane having an acryl group, an acryloyl group, a methacrylic group or a methacryloyl group, and a mixture thereof.

The organoalkoxysiloxane may preferably include, for example, trimethyltrimethoxydisiloxane, tetramethyltetramethoxytrisiloxane, hexamethyltetramethoxytetrasiloxane, alkoxysilane having an acryl group, an acryloyl group, a methacrylic group or a methacryloyl group, and a mixture thereof.

Further, a commonly used silicone-based water-repellent agent can be used, and for example, a commercially available product such as XIAMETER® OFS-6070 by Dow may be preferably used.

The envelope-type detergent composition may preferably include a) 3 parts by weight to 40 parts by weight of a nonionic surfactant; b) 5 parts by weight to 40 parts by weight of an anionic surfactant; c) 5 parts by weight to 90 parts by weight of the film-forming water-soluble polymer as the total weight thereof after drying; d) 1 part by weight to 30 parts by weight of an alkali builder; and e) 1 part by weight to 20 parts by weight of a plasticizer.

As used herein, the term "film-forming water-soluble polymer" refers to a water-soluble polymer capable of forming a film and has film-forming properties capable of forming a film matrix, but the entangled polymer chains of the film-forming water-soluble polymer are re-released by water during washing.

In the envelope-type detergent composition of the present invention, a) the nonionic surfactant may complement the cleaning ability in washing water of high hardness, thereby improving the detergency of the detergent. The nonionic surfactant is not particularly limited, but preferred examples thereof may include polyoxyethylene alkyl ether, coconut diethanolamide, fatty acid alkanolamine, amine oxide, alkyl polyglucoside, methyl polyethylene alkyl ether, sugar ether, or the like. In addition, preferably, one or more kinds may be selected and used from the group consisting of the nonionic surfactants described above.

It is preferred that the nonionic surfactant is included in an amount of 3 parts by weight to 40 parts by weight with respect to the total weight of the detergent composition for the envelope-type detergent. When the content is less than 3 parts by weight, there is a problem in that the detergency is low, and when the content is more than 40 parts by weight, there is a problem in that it is not easy to prepare the envelope-type detergent according to the present invention.

Next, b) the anionic surfactant is to function as a detergent like the nonionic surfactant. It is not particularly limited, but preferred examples thereof may include alpha sulfo fatty acid methyl ester, alpha-olefin sulfonate or sodium lauryl sulfate. Further, one or more kinds may be selected and used from the group consisting of the anionic surfactants described above.

It is preferred that the anionic surfactant is included in an amount of 5 parts by weight to 40 parts by weight with respect to the total weight of the detergent composition for the envelope-type detergent. When the content is less than 5 parts by weight, there is a problem in that the detergency is low, and when the content is more than 40 parts by weight, there is a problem in that it is not easy to prepare the envelope-type detergent according to the present invention.

Next, preferred examples of c) the film-forming water-soluble polymer may include polyvinyl alcohol (PVA) or a polyvinyl alcohol-based copolymer, and in order to secure the solubility and achieve the forming property of a film in the envelope-typed form, it is preferred that the film forming water-soluble polymer has a degree of saponification of 75% to 95% and an average degree of polymerization of 100 to 3,000. When the degree of saponification is less than 75% or more than 95%, the film-forming water-soluble polymer has low solubility and thus is not dissolved well in water. Further, when the average degree of polymerization is less than 100, the molecular weight is so low that the film is not easily formed, and physical properties such as the tensile strength of the film are not good. When the average degree of polymerization is more than 3,000, the molecular weight is so high that the film-forming water-soluble polymer is hardly dissolved in water, and even though the polymer is dissolved in water, the viscosity is so high that it is difficult to formulate into a film.

It is preferred that the film-forming water-soluble polymer is included in an amount of 5 parts by weight to 90 parts by weight as a total weight thereof after drying with respect to the total weight of the detergent composition. When the content is less than 5 parts by weight, it is difficult to prepare a film due to the low tensile strength, and when the content is more than 90 parts by weight, the content of active ingredients for laundry is so low that the detergent function deteriorates.

Next, d) the alkali builder increases the pH in the envelope-type detergent composition to enhance repulsion between fibers, thereby improving the power of removing dirt. Further, since it is possible to prevent the pH of the detergent composition from being excessively increased by an appropriate combination with acidic ingredients, it is possible to reduce the possibility of the clothes' dye migration which may occur when the laundry is laundered at high temperature due to high pH. Further, the alkali builder acts to maintain the pores of a water-soluble polymer via a neutralization reaction with acidic ingredients, thereby impregnating detergent ingredients in the polymer film.

Sodium carbonate, sodium bicarbonate, sodium sulfate, or the like may be used as the alkali builder. One or more of the alkali builders may be selected and used. The higher the content of sodium bicarbonate and sodium sulfate is, the higher the density thereof is. Thus, when sodium bicarbonate and sodium sulfate are used, it is preferred to adjust the content thereof in consideration with the aforementioned property. Sodium carbonate and sodium bicarbonate are also used as a pH adjusting agent, and thus may serve to buffer the pH of laundry water at the same time.

The alkali builder may be typically used by appropriately adjusting the content thereof according to the purpose, but is preferably included in an amount of 1 part by weight to 30 parts by weight with respect to the total weight of the detergent composition in the present invention. When the alkali builder is used in an amount of less than 1 part by weight, the pores of the polymer film are formed in a small amount so that it is difficult to impregnate detergent ingredients in the polymer film. When the alkali builder is used in an amount of more than 30 parts by weight, the solubility of the envelope-type detergent prepared is reduced.

Next, e) the plasticizer is a film-forming initiator of a polymer and is also used to impart the ductility to the envelope-type detergent. Preferred examples thereof may include trimethylol propane, ethylene glycol, dibutyl phthalate, and citric acid, and one or more kinds may be selected and used from the examples described above.

It is preferred that the plasticizer is included in an amount of 1 part by weight to 20 parts by weight with respect to the total weight of the detergent composition. When the plasticizer is used in an amount of less than 1 part by weight, the polymer film is not formed well. When the plasticizer is used in an amount of more than 20 parts by weight, the ductility is increased so much that the strength of film suitable as an envelope-type detergent may not be obtained.

Further, within a range not inhibiting the objects of the present invention, an envelope-type detergent composition according to the present invention may additionally include an additive such as a proteolytic enzyme such as protease, a lipolytic enzyme such as lipase, a carbohydrolytic enzyme such as amylase, a cellulolytic enzyme such as cellulase, a biphenyl-based or stilbene-based fluorescent dye, a bleaching agent such as sodium percarbonate, or a dye migration inhibitor in an amount of 0.3 parts by weight to 10 parts by weight with respect to 100 parts by weight of the detergent composition. When a portion of these additives is included in the detergent composition for the envelope-type detergent, it is preferred that each of the proteolytic enzyme, the lipolytic enzyme, the carbohydrolytic enzyme, and the cellulolytic enzyme is additionally included in an amount of 0.01 part by weight to 1 part by weight with respect to 100 parts by weight of the detergent composition. Further, it is preferred that the fluorescent dye is additionally included in an amount of 0.1 part by weight to 1 part by weight with respect to 100 parts by weight of the detergent composition, and it is preferred that the dye migration inhibitor is additionally included in an amount of 0.5 parts by weight to 5 parts by weight with respect to 100 parts by weight of the detergent composition.

The envelope-type detergent according to the present invention is prepared as an envelope-type detergent by a preparation method including: uniformly mixing raw materials which constitute the composition ingredients of the detergent; making the mixture into a film; and preparing the filmed detergent composition in the form of an envelope. Further, when the raw materials are mixed, one or more water-repellent compounds and the above-described additives according to the purpose may be additionally mixed. One or more water-repellent compounds and the additives may also be introduced into the outer form of the detergent envelope in a post-processing form, if necessary, and may be preferably applied to both surfaces of the envelope-type detergent in the form of a coating.

When the raw materials are mixed, they are preferably introduced within a temperature range in consideration of the boiling point of a surfactant and the melting point of a polymer.

The envelope-type detergent according to the present invention is an envelope capable of containing laundry, and the detergent composition containing a water-repellent component is included in the polymer film in a solid state. The shape of the envelope of the envelope-type detergent is not particularly limited, and it is suitable if the envelope can contain the laundry. The size of the envelope is not particularly limited and can be manufactured in various sizes. Such an envelope-type detergent has advantages in which from the time when the laundry is generated, the laundry may be stored in an envelope that is classified according to the criteria to be classified, and the laundry which may be contained in the envelope is limited so that an appropriate amount of detergent can be used. Further, the envelope-type detergent according to the present invention improves water resistance so that the shape stability of the envelope-type detergent is excellent when storing laundry with moisture.

MODE FOR INVENTION

Hereinafter, the present invention is described in more detail with reference to Examples. However, the technical idea of the present invention is not limited thereto, and various modifications and changes may be made by those skilled in the art.

Example

Preparation Example: Envelope-Type Detergent 84.0 parts by weight of polyvinyl alcohol as a water-soluble polymer, 2.0 parts by weight of trimethylolpropane as a plasticizer, 9.0 parts by weight of polyoxyethylene alkyl ether as a nonionic surfactant, 3.0 parts by weight of MES (methyl ester sulfonate 85%) as an anionic surfactant, 2.0 parts by weight of potassium carbonate as an alkali builder, 0.5 parts by weight of a protease and 2 parts by weight of a flavor were prepared. The raw materials were made into an envelope-type detergent film using a screw input facility with a heating temperature of 140° C. and a blowing film casting equipment.

Example 1

In order to enhance water resistance, a fluorine copolymer compound (manufactured by Archroma, Switzerland) as a fluorine-based perfluoroalkyl compound was applied to the surface of the envelope-type detergent film prepared in the Preparation Example using a brush, followed by drying process with an oven at 120° C. or higher for 3 minutes. The coating amount of the compound was prepared so as to be 1 part by weight with respect to the total weight of the envelope-type detergent composition of the Preparation Example, and the compound was applied thereto.

Example 2

In order to enhance water resistance, a silicone-based acrylic copolymer compound (manufactured by Archroma, Switzerland) was applied to the surface of the envelope-type detergent film prepared in the Preparation Example using a brush, followed by drying process with an oven at 120° C. or higher for 3 minutes. The coating amount of the compound was prepared so as to be 1 part by weight with respect to the total weight of the envelope-type detergent composition of the Preparation Example, and the compound was applied thereto.

Comparative Example

The detergent-type envelope prepared in the Preparation Example was used without applying a water-repellent agent.

<Evaluation of Water Resistance>

Figure 2:
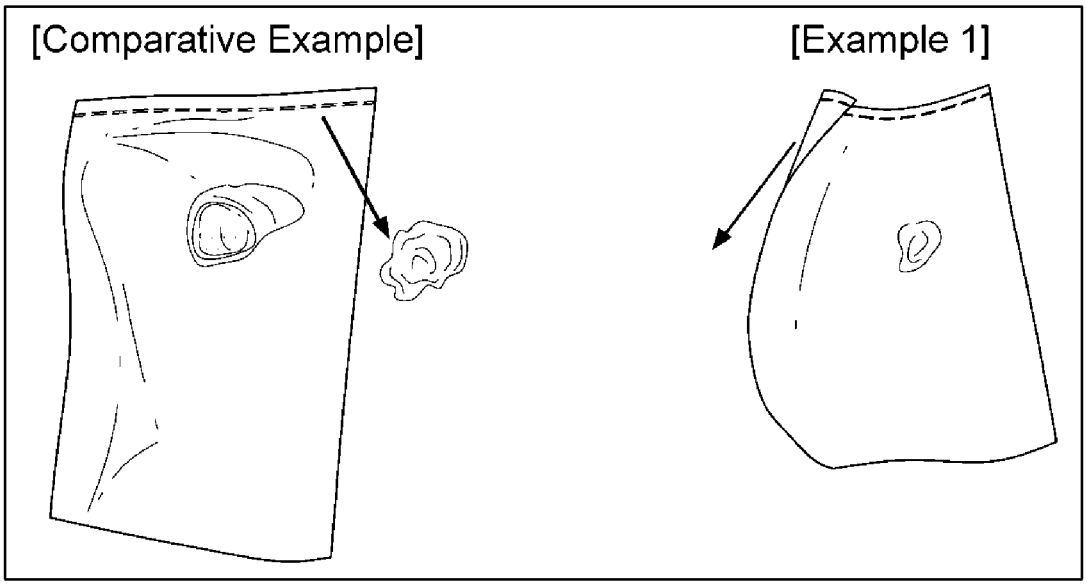
FIG. 2 is a view illustrating the results of observing whether water droplets were transmitted through the film after dropping water droplets on the envelope-type detergent films of Example 1 and Comparative Example.

The detergent-type envelopes prepared in the Examples 1 and 2 and Comparative Example were evaluated for water resistance. The evaluation was carried out by a method in which a drop of water was fallen on the film sample of the prepared detergent-type envelope, followed by visually evaluating the dissolution or the passage of time. The results are illustrated in FIGS. 1 and 2 and shown inTable 1.

Figure 3:
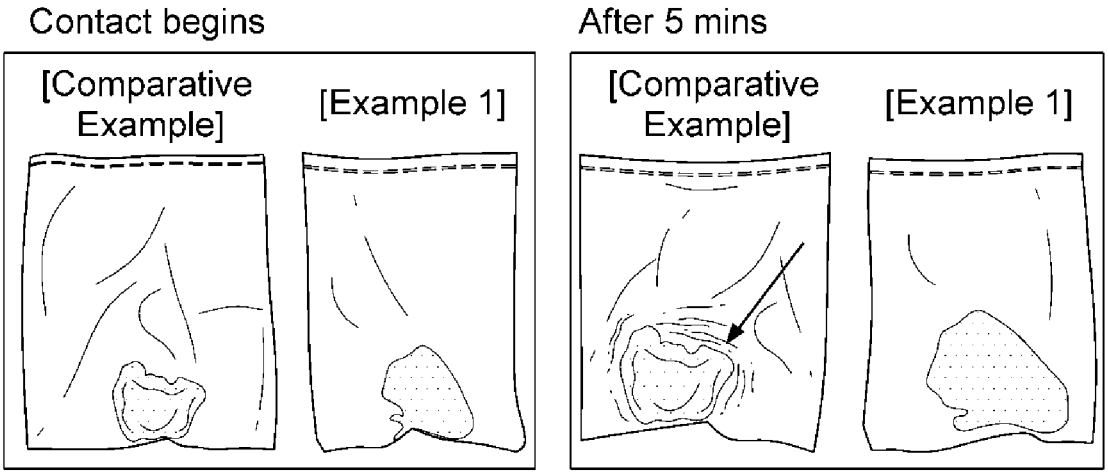
FIG. 3 is a view illustrating the results of observing changes over time after putting a wet tissue in an envelope of the envelope-type detergent films of Example 1 and Comparative Example.

In addition, wet tissue pieces were placed in detergent-type envelopes, and after 5 minutes, the state of change in the film was visually evaluated. The results are illustrated in FIG. 3 and shown in Table 1.

TABLE 1

| Item | Experimental method | Comparative Example | Example 1 | Example 2 |
|---|---|---|---|---|
| Comparison of water-repellency | Water contact | Hole creation | No deformation | No deformation |
| | Wet Tissue | Deformation | Slight deformation | Slight deformation |

According to FIG. 1, Examples 1 and 2 had no significant difference in the width or depth of the water droplet traces even when the water came into contact with the film and after 5 minutes passed. It was confirmed that in Comparative Example, when the water came into contact with the film, a large mark was formed on the film. After 5 minutes, the film was dissolved, the place where the water droplet was contacted was hollowed, and the hole was formed.

FIG. 2 illustrates that the detergent film of Example 1 was not dissolved so that there was no water permeation, whereas the detergent film of the Comparative Example was dissolved so that there was water permeation.

Further, according to FIG. 3, when a wet tissue was put in a detergent-type envelope and stored for a predetermined period of time. The deformation degree of the film was evaluated over time. As a result, in the Comparative Example, the film of the detergent-type envelope was dissolved after the elapse 5 minutes, and thus the phenomenon that the envelope was dissolved occurred. However, it was confirmed that the envelope was not deformed even after the elapse of 5 minutes in the detergent-type envelope of Example 1. That is, it was confirmed that as compared with the case where the water-repellent component was not present from the envelope-type detergent of Example 1, the phenomenon that the detergent envelope was wetted could be improved.

Further, it was confirmed that the detergent-type envelope film of the Comparative Example was easily disassociated in the water contact test and the wet material storage stability test.

INDUSTRIAL APPLICABILITY

Since the envelope-type detergent according to the present invention has a water-repellent component, even when a polymer dissolved at a low temperature is used, the water resistance is enhanced. Thus, even when the wet laundry is stored, the detergent envelope has excellent shape stability and is also convenient to store.

Further, the envelope-type detergent according to the present invention may be used while the laundry is introduced into a detergent envelope formulated into a disposable preparation, and it is possible to provide an envelope-type detergent having various sizes so that it is easy to quantify the amount of the detergent to be used.

The invention claimed is:

1. A detergent composition in the form of a laundry storage envelope, wherein the detergent composition includes:

a) 3 parts by weight to 13 parts by weight of a nonionic surfactant;

b) 3 parts by weight to 15 parts by weight of an anionic surfactant;

c) 80 parts by weight to 90 parts by weight of a film-forming water-soluble polymer as the total weight thereof after drying;

d) 1 part by weight to 12 parts by weight of an alkali builder;

e) 1 part by weight to 12 parts by weight of a plasticizer; and f) at least one water-repellent compound selected from the group consisting of a fluorine-based compound and a silicone-based compound.

2. The detergent composition in the form of the envelope according to claim 1, wherein the water-repellent compound is included in 1 part by weight to 20 parts by weight with respect to the total weight of the detergent composition.

3. The detergent composition in the form of the envelope according to claim 1, wherein the fluorine-based compound is at least one selected from the group consisting of a fluorine-based perfluoro alkyl compound, a perfluoro silane compound, a mixture thereof and a polymer thereof.

4. The detergent composition in the form of the envelope according to claim 1, wherein the silicone-based compound includes at least one selected from the group consisting of alkyl alkoxy silane, organo alkoxy siloxane, a mixture thereof and a polymer thereof.

5. The detergent composition in the form of the envelope according to claim 1, wherein a) the nonionic surfactant includes at least one selected from the group consisting of polyoxyethylene alkyl ether, coconut diethanolamide, fatty acid alkanolamine, amine oxide, alkylpolyglucoside, methyl polyethylene alkyl ether, and sugar ether.

6. The detergent composition in the form of the envelope according to claim 1, wherein b) the anionic surfactant includes at least one selected from the group consisting of alpha-sulfo fatty acid methyl ester salt, alpha-olefin sulfonate and sodium lauryl sulfate.

7. The detergent composition in the form of the envelope according to claim 1, wherein c) the film-forming water-soluble polymer is polyvinyl alcohol having a degree of saponification of 75% to 95% and an average degree of polymerization of 100 to 3,000.

8. The detergent in the form of the envelope according to claim 1, wherein d) the alkali builder includes at least one selected from the group consisting of potassium carbonate, sodium carbonate, sodium bicarbonate and sodium sulfate.

9. The detergent composition in the form of the envelope according to claim 1, wherein e) the plasticizer includes at least one selected from the group consisting of trimethylol propane, ethylene glycol, dibutyl phthalate and citric acid.

10. The detergent composition in the form of the envelope according to claim 1, wherein the detergent composition further includes at least one additive selected from the group consisting of a flavor, a protease, a lipase, a carbohydrase, a cellulolytic enzyme, a bleach, a fluorescent dye, a dye migration inhibitor in an amount of 0.3 parts by weight to 10 parts by weight with respect to 100 parts by weight of the detergent composition.

* * * * *